US006053572A

United States Patent [19]

Doran

[11] Patent Number: 6,053,572

[45] Date of Patent: Apr. 25, 2000

[54] DEVICE FOR FACILITATING ACCESS TO SITTING POSITION ON CAR SEAT

[76] Inventor: Michele R. Doran, 123 S. Wheeling Ave., Wheeling, Ill. 60090

[21] Appl. No.: 09/264,698

[22] Filed: Mar. 8, 1999

[51] Int. Cl.[7] ..... A47C 31/00

[52] U.S. Cl. ..... 297/219.1; 297/242; 5/653

[58] Field of Search ..... 297/219.1, 229, 297/242; 5/926, 81.1 HS, 653

[56] References Cited

U.S. PATENT DOCUMENTS

| | | | |
|---|---|---|---|
| 2,576,004 | 11/1951 | Fair . | |
| 2,944,591 | 7/1960 | Morrill, Jr. . | |
| 3,043,622 | 7/1962 | Milner . | |
| 3,232,662 | 2/1966 | Graves . | |
| 4,034,947 | 7/1977 | Geisel . | |
| 5,238,293 | 8/1993 | Gibson | 297/229 |
| 5,390,978 | 2/1995 | Janisch . | |
| 5,441,329 | 8/1995 | Janisch . | |
| 5,465,441 | 11/1995 | Chun | 5/926 |
| 5,499,862 | 3/1996 | Janisch . | |
| 5,618,082 | 4/1997 | Jachmich | 297/219.1 |
| 5,787,523 | 4/1998 | Lindberg | 5/81.1 HS |
| 5,809,595 | 9/1998 | Stevens et al. | 297/219.1 |

FOREIGN PATENT DOCUMENTS

| | | | |
|---|---|---|---|
| WO87/04614 | 8/1987 | WIPO | 5/926 |

*Primary Examiner*—Anthony D. Barfield
*Attorney, Agent, or Firm*—Patula & Associates

[57] ABSTRACT

A device for facilitating access to a car seat takes the form of a multi-laminate plastic, rotating seat device or disk having a plurality of fold lines defining a plurality of segments. The disk is placed upon the seating area of a car seat and substantially covers the entire seating area, preferably with overhang. The fold lines and segmented nature of the disk allow the disk to generally assume the contour of the car seat, when in use, and to be folded into a compact, portable size when not in use. The outer surfaces of the disk preferably have differing coefficients of friction to allow the disk to be reversible for use on different type car seat upholstery. Further, the disk is provided with an indicia to serve as a decorative cover for the car seat. The device could take the form of an oval and be provided with a crimped perimeter and hand grip cutouts.

15 Claims, 3 Drawing Sheets

DEVICE FOR FACILITATING ACCESS TO SITTING POSITION ON CAR SEAT

The present invention relates to seats and particularly a device for seats, specifically, to a device for facilitating access to a sitting position on a seat, especially a car seat, and having the characteristics of being lightweight, flexible, and portable, among others.

BACKGROUND OF THE INVENTION

Getting into and out of a car is often taken for granted by millions of people. However, to some, getting into and out of a car can be a painful and difficult ordeal. The bending and twisting motion involved with getting into and out of a car can cause a tremendous strain on a person's back, neck and other parts of the body. Such a strain can cause injury, for example to muscles in the back, or can aggravate an existing injury or condition. Often, people with existing back pain, elderly people with limited mobility, or others with handicaps need assistance in getting into and out of a car seat.

There exist a number of prior art devices to assist people in this regard. However, these prior art devices are often expensive, complicated and/or cumbersome devices having many parts which can wear down or malfunction. Further, each of these prior art devices contain limitations and/or disadvantages which hinder use.

For example, U.S. Pat. No. 5,499,862 issued to Janisch on Mar. 19, 1996, discloses a "Turntable" having a padded cushion and being pivotably mounted on a bottom plate. The cushion is fixed in position on the top plate by a rigid retaining ring. The turntable of Janisch is complicated and cumbersome, and would be extremely uncomfortable if used on a car seat. Further, the turntable of Janisch is not flexible, foldable or readily portable. Additionally, the disclosed device is not designed to be reversible, and has parts which could tear or damage leather or cloth car seats.

Similarly, U.S. Pat. No. 5,441,329 issued to Janisch on Aug. 15, 1995, discloses a "Rotatable Seat" having an upholstery pad and being pivotably mounted on a bottom plate. The pad is fixed in position on the top plate by a retaining ring. This rotatable seat of Janisch is again complicated and cumbersome, and would be extremely uncomfortable if used on a car seat. Further, the rotatable seat of Janisch is not flexible, foldable or readily portable. Additionally, the disclosed device is not designed to be reversible, and has parts which could tear or damage leather or cloth car seats.

U.S. Pat. No. 5,390,978 issued to Janisch on Feb. 21, 1995, discloses a "Rotatable and Displaceable Seat" comprising a two-piece rotary plate and bottom plate combination. The rotary plate is pivotably mounted on the oblong bottom plate and is displaceable therealong. The rotary plate features a central pin which can engage the bottom plate to prevent displacement. Again, Janisch's rotatable seat is complicated and cumbersome and includes many parts which could malfunction. Further, the rotatable and displaceable seat would be relatively expensive to manufacture, and is not readily foldable to a compact size or easily transportable. Additionally, the disclosed device is not designed to be reversible, and has parts which could tear or damage leather or cloth car seats.

U.S. Pat. No. 4,034,947 issued to Geisel on Jul. 12, 1977, discloses a "Rotating Seat Device," having two flat, disc-shaped members and means for interconnecting and permitting relative rotational movement between the members. Thus, Geisel's seat device contains multiple pieces which could wear or break. Further, Geisel does not provide for folding of the seat device into a compact and easily portable size. Additionally, the disclosed device is not designed to be reversible, and has parts which could tear or damage leather or cloth car seats.

U.S. Pat. No. 3,232,662 issued to Graves on Feb. 1, 1966, discloses a very complex and cumbersome "Combination Tray and Seat Apparatus." The tray is pivotably mounted to a swivel seat. Graves apparatus is bulky and results in a user being elevated several inches off of the seat. Further, the seat is not flexible or foldable and has numerous parts which could malfunction or damage the seat cover.

U.S. Pat. No. 3,043,622 issued to Milner on Jul. 10, 1962, discloses a "Movable Seat" comprising a base plate and a top plate, both made of hardened plastic. The top plate supports a cushion. The movable seat is fastened to a car set by a flexible strap. The base plate and top plate are connected by guide and pivot means. The movable seat of Milner is complicated and cumbersome. Further, this movable seat is not flexible or foldable, nor is it readily portable. Additionally, the disclosed device is not designed to be reversible, and has parts which could tear or damage leather or cloth car seats.

U.S. Pat. No. 2,944,591 issued to Morrill, Jr. on Jul. 12, 1960, discloses a "Swivel Seat Attachment" comprising a rigid panel attached to a pocket-like sleeve containing bearings therein. The panel swivels on the sleeve along an arc. The sleeve is tethered to the car seat. The seat attachment of Milner is complicated and cumbersome and would be ineffective on certain types of seats such as bucket seats. Further, this seat attachment is not flexible or foldable, nor is it readily portable. Additionally, the disclosed device is not designed to be reversible, and has parts which could tear or damage leather or cloth car seats.

U.S. Pat. No. 2,576,004 issued to Fair on Nov. 20, 1951, discloses a "Semirevolving Vehicle Seat" wherein the actual car seat is designed to pivot. Fair's vehicle seat is complicated and cannot be used in connection with traditional car seats. Fair's seat is obviously not flexible or portable and cannot be folded into a compact size.

Accordingly, there is a need for an inexpensive, uncomplicated device for facilitating access to a sitting position in a car, which is flexible for use with all types and sizes of car seats, which is readily portable by folding to a compact size, and which has no parts which could malfunction or cause damage to the car seat.

BRIEF SUMMARY OF THE INVENTION

The present invention is an inexpensive device for facilitating access to a sitting position on a car seat. The device consists of a generally circular disk of plastic material, and in particular multi-laminate layers of polyethylene material that resists tears and punctures. The disk is sized to cover substantially the entire seating area of the car seat, and preferably providing some overhang as well. The device is flexible and includes a plurality of fold lines so that the device can be folded into a compact size. Thus, the device is lightweight and is easily portable. The device contains no moving/mechanical parts, eliminating the potential for malfunction or damage to the car seat. The flexibility of the device allows the same to be used without compromise on any type of car seats, including uneven seats, such a bucket seats. Further, use of the device causes no discomfort to the user, and virtually cannot be felt at all.

Other embodiments of the present invention include the device having weight means, such as small weight discs to assist in keeping the device in place on a seat. Further, another embodiment includes the device having two layers wherein the outer surface of each layer has a different coefficient of friction. In this manner, the device is reversible and provides the desired rotation on varying types of seat surfaces. For example the device could include a first layer of plastic and a second layer of cloth. When used on leather seats, the cloth side would be placed down to provide easy rotation. On cloth seats, the plastic side would be placed down to provide easy rotation.

In another embodiment, the device includes an indicia, to provide a decorative cover for the car seat. The indicia could be any symbol or words. For example, the indicia could state the make of a car, or it could be the symbol of a car company. The indicia could be school emblems or logos, or logos and names of sports teams and the like. The device itself could further be of varying colors.

A further embodiment illustrates the device in the form of an oval shape. The device further includes a crimped perimeter, and hand cutouts to facilitate gripping of the device and lifting from the seat.

Accordingly, it is the principle object of the present invention to provide a device for facilitating access to a sitting position on a car seat.

It is a further object of the present invention to provide for an inexpensive rotatable seat device that can be folded into a compact size.

It is another object of the present invention to provide a rotatable seat device that is lightweight and easily portable.

It is also an object of the invention to provide a rotatable seat device that is sized to cover substantially the entire seating area and additionally providing overhanging portions.

It is an additional object of the present invention to provide for a rotatable seat device that resists tears and punctures.

It is yet another object of the present invention to provide a rotatable seat device which eliminates the potential for malfunction or damage to a car seat or to a user's clothing.

It is a still further object of the present invention to provide for a rotatable seat device that is flexible and can be used on any type of car seat, including uneven seats.

It is still another object of the present invention to provide a rotatable seat device that causes no discomfort to the user.

It is another additional object of the present invention to provide for a rotatable seat device that is reversible for use on varying types of seat surfaces.

It is also a further object of the present invention to provide a rotatable seat device that can also serve as a decorative and protective cover for a car seat.

Numerous other advantages and features of the invention will become readily apparent from the detailed description of the preferred embodiment of the invention, from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
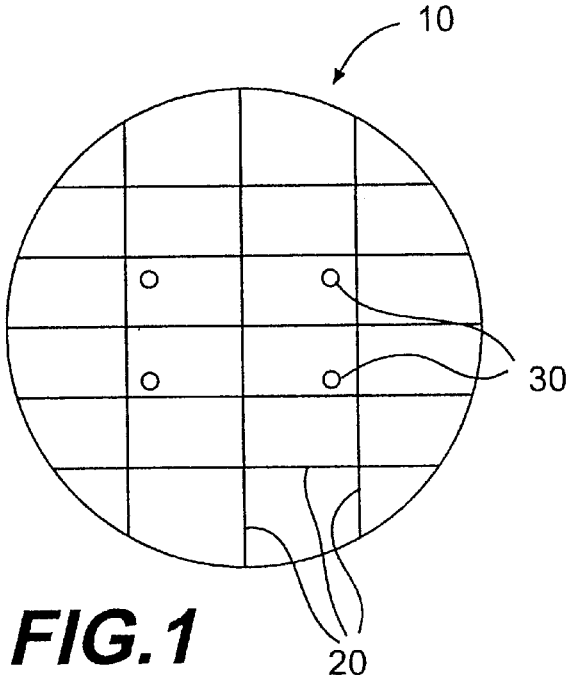
FIG. 1 is a top view of the seat device of the present invention.

While the invention is susceptible of embodiment in many different forms, there is shown in the drawings and will be described herein in detail a preferred embodiment of the present invention. It should be understood, however, that the present disclosure is to be considered an exemplification of the principles of the invention and is not intended to limit the spirit and scope of the invention and/or claims of the embodiment illustrated.

FIG. 1 illustrates a top view of the present invention comprising generally a circular disk 10. The disk 10 is preferably made of a flexible material than can be folded, yet is of a sufficient strength to resist tears and punctures. To this end, the disk 10 is preferably formed from multi-laminate plastic or polyethylene material. It should be understood however that other materials could be used and the present invention should not be deemed limited as such.

As can be seen in FIG. 1, disk 10 has a plurality of fold lines 20. The fold lines allow the disk 10 to be easily folded into a compact, portable size as discussed below. Any suitable number of fold lines 20 in any suitable locations are envisioned, so long as the disk 10 can be readily folded into a compact, portable size.

FIG. 1 further illustrates optional weight means 30 located in various locations on the disk 10. Weight means 30 are used to assist in keeping the disk 10 in a desired location on a seat. It is foreseen that weight means 30 could take any suitable form and can be attached in any suitable manner to disk 10. Further, any number of weight means 30 could be used and located in any desired location on disk 10. As illustrated, weight means 30 take the form of weight disks suitably attached to or integrally formed within disk 10.

Figure 2:
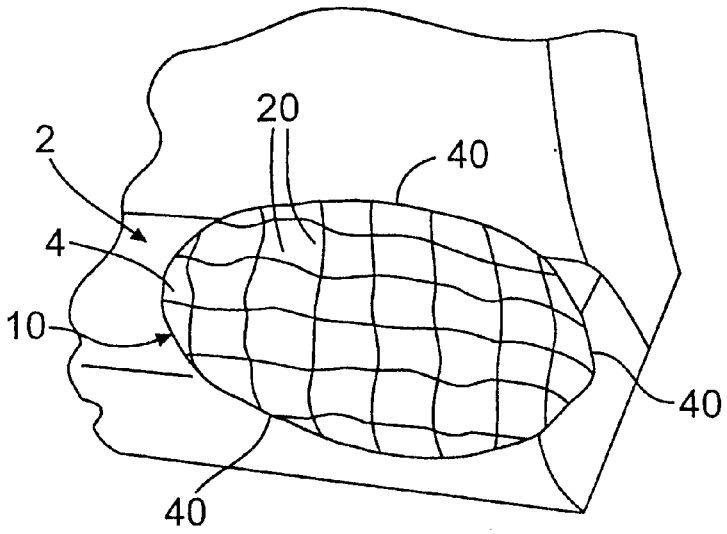
FIG. 2 is a perspective view of the present invention positioned for use on a car seat, and in particular a bench-type seat.

Referring now to FIG. 2, as can be seen, disk 10 with fold lines 20 is positioned on the driver's side of a bench type car seat 2, on the seating surface 4. Disk 10 is sized to cover substantially all of the seating area of the car seat 2. The seating area is defined as that area on the car seat where a majority of users would normally come into contact with. It has been found that a desired and suitable size for the disk 10 is within a range of twenty-five inches (25") to twenty-eight inches (28"), and preferably twenty six and one half inches (26½"). When disk 10 is sized in this range, it has been found to suitably cover most if not all of the various car seats of the various makes of cars.

Further, when sized in this range, disk 10, when in use on a car seat, preferably provides desired overhang portions 40, as illustrated in FIG. 2. One overhang portion 40 is located at a back area of the seat, where the generally horizontal seating area meets the generally vertical or upright back support of the car seat 2. This overhang portion curls upward to rest against the back support. Fold lines 20 facilitate the curling action of the overhang portion. Also, as the disk 10 rotates during use, the fold lines facilitate the continuous changing of the overhang portions. The fold lines result in a segmented disk, where as the disk rotates, each individual section can curl or deform as necessary to conform to the configuration of the car seat at the various locations. This action allows the present invention to be used on any type of car seat of any configuration.

Another overhang portion 40 is located at a side area of the seat, located adjacent to the car door (not shown). This overhang portion curls downward, along the vertical side portion of the car seat. The third overhang portion 40 is located at the front area of the seat. Again, this overhang portion curls downward, along the vertical front portion of the car seat. Fold lines 20 again facilitate the curling action of the overhang portions.

The overhang portions ensure that substantially all of the seating area remains covered during use, and further eliminate unwanted friction arising from contact with the seat by, for example, loose clothing. If a user's clothing contacts the seat, it has a tendency to catch or grab as a person swings into the seated position. This results in the clothing becoming twisted or out of position, resulting in discomfort to the wearer. The present invention tends to eliminate or lessen this undesired twisting of a user's clothing.

Figure 3:
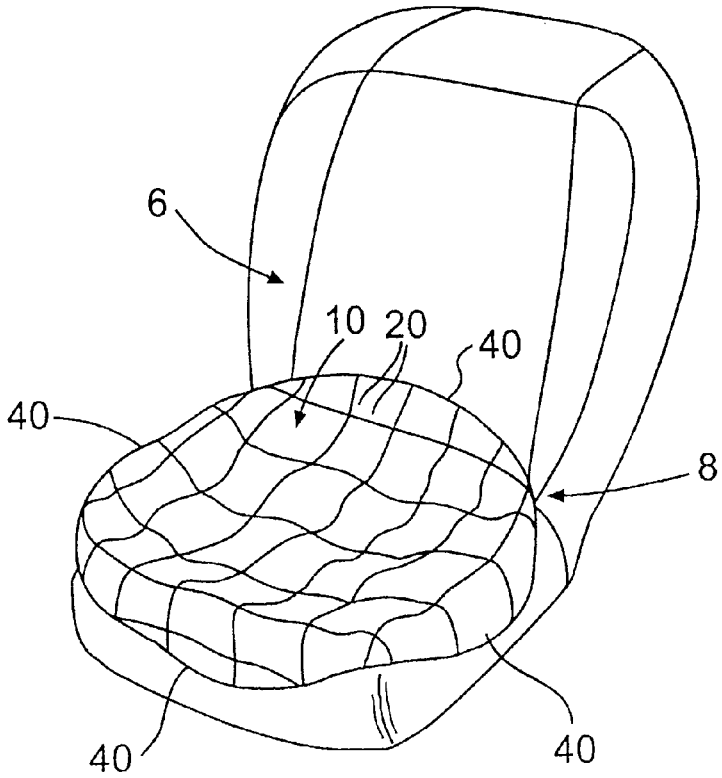
FIG. 3 is a perspective view of the present invention positioned for use on a car seat, and in particular a bucket-type seat.

FIG. 3 illustrates the present invention in use on a bucket type car seat 6, on the seating surface 8. Again, disk 10 is sized to cover substantially all of the seating area of the car seat 6. In this instance, disk 10 takes the form of having four overhang portions 40, at the back, front and both sides of the seating area. Overhang portions 40 curl upwards, conforming to the contour of the bucket seat. Fold lines 20 again facilitate this curling actions, and facilitate proper rotation of the disk 10 as a whole while maintaining the contoured form. Preferably, overhang portions 40 would extend up and around the upper edges of the seating area of the bucket seat. In other words, the overhang portions at the front and both sides of the seat would first curl up along the bucket seat, and then begin to curl down along the vertical portions of the seat.

Figure 4:
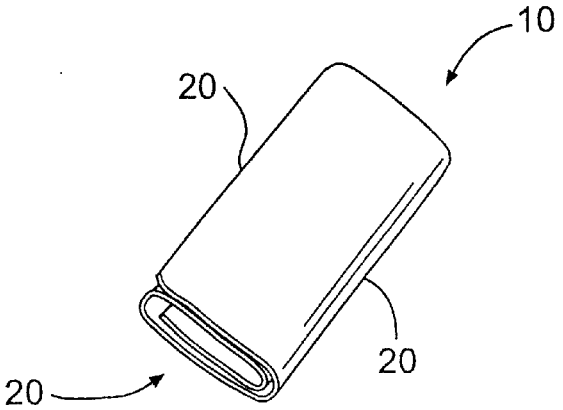
FIG. 4 is a perspective view of the present invention in its compact, folded position.

FIG. 4 illustrates the disk 10 having been folded along fold lines 20 into a compact, portable size. As stated above, the disk 10 could be folded in any suitable manner along any pattern of fold lines 20. For example, the disk 10 could be folded in the same manner as a map is folded. In any event, the disk 10 can be folded to any compact size, for example, a three inch (3") by four inch (4") package. When folded as such, the disk is extremely easy the carry around, and could be placed in a pocket, a wallet or purse, a briefcase, etc. When needed, the disk 10 can easily and quickly be unfolded and positioned on the car seat.

Figure 5:
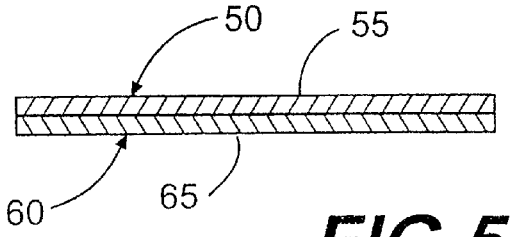
FIG. 5 is a cross sectional view of an alternate embodiment of the present invention.

FIG. 5 illustrates a cross-section of one embodiment of the present invention wherein the disk 10 is comprised of multiple layers. As shown, a first layer 50 is suitably affixed to a second layer 60 in such a manner as to prevent relative movement therebetween. Layer 50 has an outside surface 55 and layer 60 has an outside surface 65. Preferably, layer 50 and layer 60 are formed from differing materials, or materials which have differing coefficients of friction. In this manner, the present invention is reversible and can be used on car seats having different upholstery, such as leather seats and cloth seats.

For example, layer 50 could be multi-laminate plastic and layer 60 could be cloth or fabric. Thus, when used on leather car seats, layer 60 would be placed down against the leather seat surface to lessen the frictional forces between the contacting surfaces and facilitate rotation of the disk on the seat. On the other hand, when used on cloth car seats, layer 50 would be placed down against the cloth seat surface to lessen the frictional forces between the contacting surfaces and facilitate rotation of the disk on the seat. It should be understood that any desired combination of material could be used for the layers to achieve the desired reversibility of the disk 10.

Figure 6:
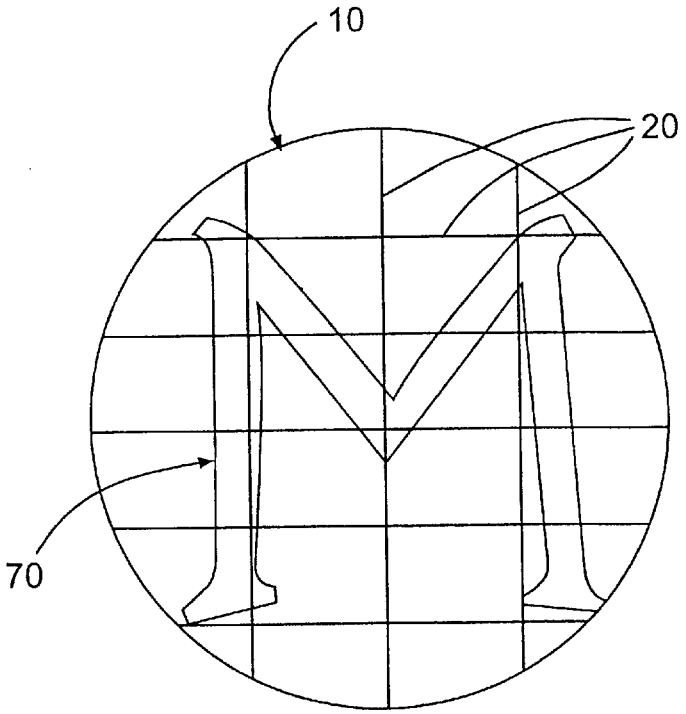
FIG. 6 is a top view of another embodiment of the present invention.

Referring now to FIG. 6, disk 10 having fold lines 20 is shown having an indicia 70 thereon, which allows disk 10 to further serve as a decorative cover for the car seat. For the sake of illustration, indicia 70 is shown as "the letter M." However, it should be understood that indicia 70 could take any form, including words, colors, symbols, logos, pictures, etc. It is foreseen that the indicia 70 could relate to the specific car wherein the disk 10 is being used. For example, if the disk 10 was being used in a Ford Mustang, the indicia could take the form of Ford's Mustang horse logo. Further, the indicia could take the form of the letters "B" "M" and "W" if the disk is to be used in a BMW auto. In general, the indicia could take any desired form from sports teams names and logos, to college names and logos, to holiday greetings or symbols, and even to portraits of individual people.

Figure 7:
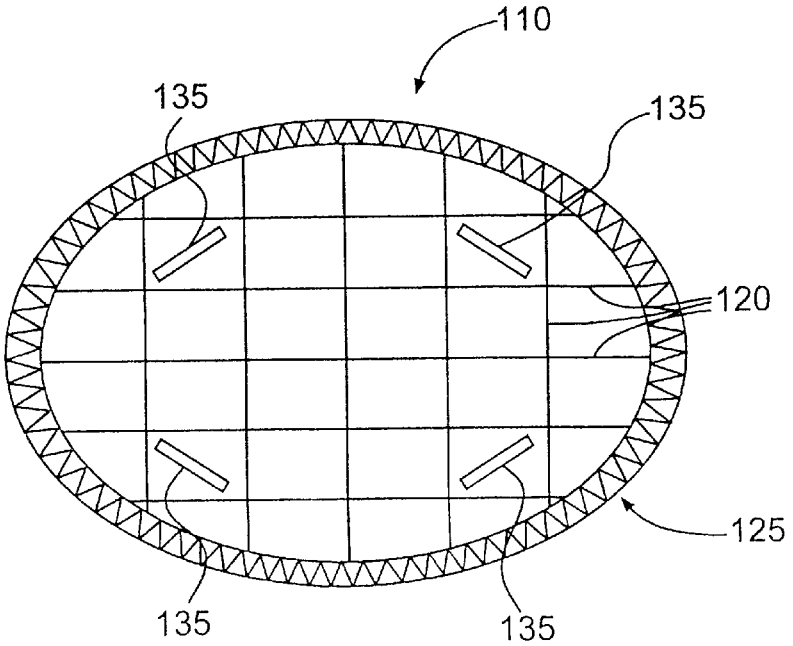
FIG. 7 is a top view of yet another embodiment of the present invention.

FIG. 7 illustrates a top view of an alternate embodiment of the invention. In this embodiment, the disk 110 is oval shaped, having preferred dimensions of 35"–40" along its major axis, and 25"–30" along its minor axis. Disk 110 includes a plurality of fold lines 120, so that the disk 110 can be readily folded to a compact size for transport or storage. Provided around the outer edge of disk 110 is crimped portion 125. Crimped portion 125, which provides ridges or raised areas, facilitates a user's ability to grasp the edge of the disk when attempting to move or lift the disk from the seating area. It should be understood that the crimped portion 125 need not extend around the entire disk, but could be included only at opposite sides or at various locations along the perimeter of disk 110. Additionally, at least one hand grip cutout 135 (four illustrated) is provided in disk 110 to further facilitate lifting or moving of the disk, especially if a person or object has been placed thereupon.

In this regard, it is foreseen that oval disk 110 could be used for transporting a person or an object on the back seat of a car, and specifically for facilitating the placement on and removal of the person or object from the seat. For example, a person with limited movement, due to hip replacement surgery, knee surgery, or a broken leg, etc., could sit on the device at the edge of the seat. Another person could then grasp disk 110 via hand cutouts 135 and pull the disabled person completely onto the car seat. The oval shape allows a significant portion of a user's leg to remain on the surface of the disk 110 while being pulled into the car, thus eliminating friction from a user's leg on the car seat. The disk 110 could be used in a similar manner for large or heavy objects such as televisions, furniture, etc. The person or object could be removed from the car seat in the same manner. The device would further serve to protect the seat from potential damage which could occur when dragging a heavy object across a car seat.

It is to be understood that the embodiments herein described are merely illustrative of the principles of the present invention. Various modifications may be made by those skilled in the art without departing from the spirit or scope from the claims which follow. For example, the disk should not be limited to use on a car seat, but could be used on any seat where a bending or twisting motion is needed to arrive at the seated position.

What is claimed is:

1. A device for facilitating access by a user to a sitting position on a car seat defining a contour and a sitting area, said device comprising:

a sheet-like member having a first surface and a second surface, said sheet-like member defining an area adapted to cover said sitting area of said seat;

a plurality of fold lines in said member, said member conforming to the contour of said seat when placed on said seat;

said member rotating relative to said seat when said user accesses said seat to facilitate access to said seat by preventing contact between said user and said sitting area of said seat;

said member rotating in unison with the user, and not rotating relative to said user when said user accesses said seat.

2. The device of claim 1 having at least one means for gripping in said sheet-like member.

3. The device of claim 2, wherein said sheet-like member is oval in shape.

4. The device of claim 3, wherein said sheet-like member is reversible.

5. The device of claim 2, wherein said at least one means for gripping comprises a crimped portion.

6. The device of claim 2, wherein said at least one means for gripping comprises a cutout.

7. A rotatable seat device for a car seat having a sitting surface and defining a contour and a coefficient of friction, said device comprising:

a circular disk having a first surface and a second surface each defining a coefficient of friction;

a plurality of fold lines in said circular disk defining a plurality of segments;

said disk being adapted to substantially cover said sitting surface, being flexible to conform to the contour of said car seat when in use, and being foldable to a compact, portable size when not in use;

said disk rotating on said sitting surface to facilitate access to said seat by preventing contact between a user and said sitting surface of said seat.

8. The device of claim 7, wherein said disk includes overhang portions which extend past the sitting area of the seat.

9. The device of claim 8, wherein said disk is 26½ inches in diameter.

10. The device of claim 7, wherein said disk is sized within the range of 25 inches to 28 inches in diameter.

11. The device of claim 7, wherein said disk is formed of multi-laminate plastic.

12. The device of claim 7, wherein the coefficient of friction of the first surface and the second surface is not equal.

13. The device of claim 7, wherein the disk includes weight means for maintaining the disk in a desired location on the car seat.

14. The device of claim 7, wherein said disk is comprised of two layers of differing material.

15. The device of claim 7, wherein said disk includes an indicia on at least one of said first surface and said second surface.

* * * * *